US007409947B2

(12) United States Patent
Koyama

(10) Patent No.: US 7,409,947 B2
(45) Date of Patent: Aug. 12, 2008

(54) FUEL VAPOR TREATMENT APPARATUS

(75) Inventor: Nobuhiko Koyama, Nagoya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/606,945

(22) Filed: Dec. 1, 2006

(65) Prior Publication Data

US 2007/0137622 A1 Jun. 21, 2007

(30) Foreign Application Priority Data

Dec. 20, 2005 (JP) ..... 2005-366122

(51) Int. Cl.
*F02M 33/02* (2006.01)
*F02M 33/04* (2006.01)

(52) U.S. Cl. ..... 123/520; 123/519

(58) Field of Classification Search ..... 123/520, 123/519, 518, 516, 198 D; 73/118.1
See application file for complete search history.

(56) References Cited

U.S. PATENT DOCUMENTS 5,881,700 A * 3/1999 Gras et al. ..... 123/520
5,975,062 A * 11/1999 Bonse et al. ..... 123/519
6,604,407 B2 * 8/2003 Kano et al. ..... 73/49.7
6,695,895 B2 2/2004 Hyodo et al.
2002/0139173 A1 * 10/2002 Kano et al. ..... 73/49.7

FOREIGN PATENT DOCUMENTS

JP 05-018326 1/1993

OTHER PUBLICATIONS

U.S. Appl. No. 11/453,049, filed Jun. 2006, Koyama et al.

* cited by examiner

*Primary Examiner*—Mahmoud Gimie
(74) *Attorney, Agent, or Firm*—Nixon & Vanderhye PC

(57) ABSTRACT

A fuel vapor treatment apparatus is provided with a purging passage for introducing and purging fuel vapor produced in a fuel tank to an intake system for an internal combustion engine, a volume chamber located in the purging passage for enlarging a passage volume and a pump received in the volume chamber for generating a fluid flow in the purging passage.

12 Claims, 12 Drawing Sheets

| | | VALVE 22 | FIRST VALVE 33 | PURGE VALVE 35 | SECOND VALVE 54 | VALVE 56 |
|---|---|---|---|---|---|---|
| CONCENTRATION MEASUREMENT | S11 | OPEN | II | CLOSE | II | OPEN |
| | S12 | OPEN | I | CLOSE | I | OPEN |
| PURGE | S22 | OPEN | I | OPEN | I | CLOSE |
| LEAK DETECTION | S31 | CLOSE | II | CLOSE | II | OPEN |
| | S32 | CLOSE | II | CLOSE | II | CLOSE |

I : 1ST STATE
II : 2ND STATE

FUEL VAPOR TREATMENT APPARATUS

CROSS-REFERENCE TO RELATED APPLICATION

This application is based on Japanese Patent Application No. 2005-366122 filed on Dec. 20, 2005, the disclosure of which is incorporated herein by reference.

FIELD OF THE INVENTION

The present invention relates to a fuel vapor treatment apparatus which treats fuel vapor produced in a fuel tank.

BACKGROUND OF THE INVENTION

There is conventionally known a fuel vapor treatment apparatus in which a fluid flow is generated by a pump in a purging passage for introducing fuel vapor produced in a fuel tank to an intake system for an internal combustion engine, forcibly purging the fuel vapor (for example, refer to JP-2002-332921A, U.S. Pat. No. 6,695,895). In such a fuel vapor treatment apparatus, in order to avoid the state where an air-fuel ratio control for the engine is complicated due to the fluctuation of a purge concentration of the fuel vapor, it is desirable to stabilize the purge concentration.

In addition, there is known a fuel vapor treatment apparatus which generates a fluid flow by an intake vacuum in an internal combustion engine in a fuel vapor passage where the fuel vapor produced in a fuel tank flows and at the same time, detects a physical quantity such as a flow quantity in correlation with a fuel vapor concentration in the fuel vapor passage, calculating a fuel vapor concentration from the detection result (for example, refer to JP-5-18326A). In such a fuel vapor treatment apparatus, in order to implement a prompt concentration measurement, it is desirable to stabilize the fuel vapor concentration in the fuel vapor passage.

However, in the apparatus for communicating a purging passage with a fuel tank through a canister, which is disclosed in JP-2002-332921A, since the concentration of the fuel vapor desorbed from the canister and flowing into the purging passage changes with time in response to a remaining fuel adsorption quantity in the canister, it is difficult to stabilize the purge concentration. Further, when the pump is located as exposed to an outside, an operating sound of the pump may be the cause of noises.

In the apparatus for communicating a fuel vapor passage with a fuel tank through a canister, which is disclosed in JP-5-18326A, since the concentration of the fuel vapor desorbed from the canister and flowing into the fuel vapor passage changes with time in response to a remaining fuel adsorption quantity in the canister, it takes time to measure the purge concentration. Yet, since the detection quantity is easily changed due to the fluctuation of an intake vacuum, this makes it more difficult to promptly carry out the concentration measurement.

SUMMARY OF THE INVENTION

The present invention has been made in view of the foregoing problems and an object of the present invention is to provide a fuel vapor treatment apparatus which stabilizes a concentration of fuel vapor to be treated and restricts generation of noises.

Another object of the present invention is to provide a fuel vapor treatment apparatus which facilitates an air-fuel ratio control for an internal combustion engine.

A further object of the present invention is to provide a fuel vapor treatment apparatus which shortens concentration measurement time of fuel vapor to be treated.

According to an aspect of the present invention, a volume chamber is provided in a purging passage for introducing and purging fuel vapor into an intake system for an internal combustion engine, thus increasing a passage volume of the fuel vapor. Thereby, the fuel vapor is diffused due to flowing from the upstream side of the volume chamber in the purging passage into the volume chamber and therefore, the concentration of the fuel vapor is diluted. Therefore, even if the fuel vapor concentration at the upstream side of the volume chamber in the purging passage changes with time, since the change of the fuel vapor concentration with time in the volume chamber is averaged, the fuel vapor concentration at the downstream side of the volume chamber in the purging passage becomes stable. Further, a pump for generating a fluid flow in the purging passage forcibly generates a flow of the fuel vapor flowing into the volume chamber, facilitating stabilization of the fuel vapor concentration and forcibly purging the fuel vapor of the stabilized concentration. In addition, since the pump is received in the volume chamber, an operating sound of the pump can be blocked by the walls of the volume chamber.

BRIEF DESCRIPTION OF THE DRAWINGS

Other objects, features, and advantages of the present invention will become more apparent from the following detailed description made with reference to the accompanying drawings, in which like portions are designated by like reference numbers and in which.

DETAILED DESCRIPTION OF EXAMPLE EMBODIMENT

A plurality of embodiments of the present invention will be hereinafter explained with reference to the accompanying drawings. Components identical to those in each embodiment are referred to as identical numerals and the same explanation is omitted.

First Embodiment

Figure 1:
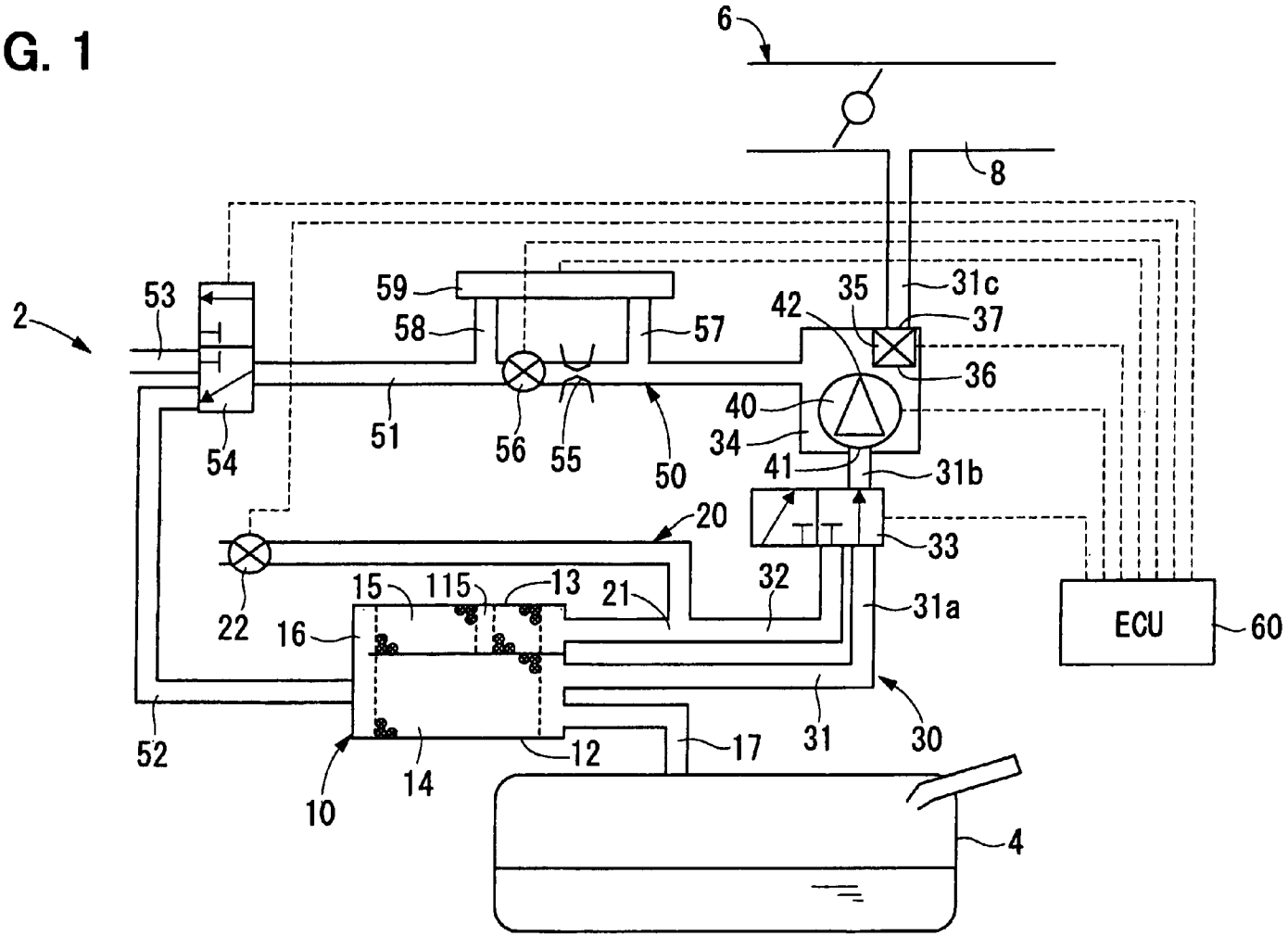
FIG. 1 is a structural diagram showing a fuel vapor treatment apparatus in a first embodiment of the present invention.

FIG. 1 shows a fuel vapor treatment apparatus 2 in a first embodiment of the present invention. The fuel vapor treatment apparatus 2 treats produced in a fuel tank 4 and feeds the treated fuel vapor to an internal combustion engine 6. The fuel vapor treatment apparatus 2 is provided with a canister 10, an atmospheric release control system 20, a purging system 30, a pump 40, a detection system 50, and an electronic control unit (ECU) 60.

The canister 10 has two adsorbing parts 12 and 13 formed by dividing its inside with a partition wall. Each of the adsorbing parts 12 and 13 is filled with adsorbing materials 14 and 15 respectively, made of active carbon, silica gel, or the like. Each of the adsorbing parts 12 and 13 is in communication with each other through a communicating space 16. The main adsorbing part 12 is communicated with the fuel tank 4 through a tank passage 17 and also is communicated with a purging passage 31 of the purging system 30 at the opposite side to the communicating space 16 so as to sandwich the adsorbing material 14. Accordingly, the fuel vapor produced in the fuel tank 4 enters into the main adsorbing part 12 through the tank passage 17 and is adsorbed by the adsorbing material 14 in such a way as to be desorbed to the purging passage 31. The sub adsorbing part 13 is communicated with a first atmosphere passage 21 of the atmospheric release control system 20 at the opposite side to the communicating space 16 so as to sandwich the adsorbing material 15. In the first embodiment, the adsorbing material 15 of the sub adsorbing part 13 is divided into two sections which are located in such a way as to sandwich an communicating space 115 with each other. However, the adsorbing material 15 may be divided into three or more, or may not be divided. In addition, the adsorbing material 14 of the main adsorbing part 12 may be divided into plural sections.

Figure 2:
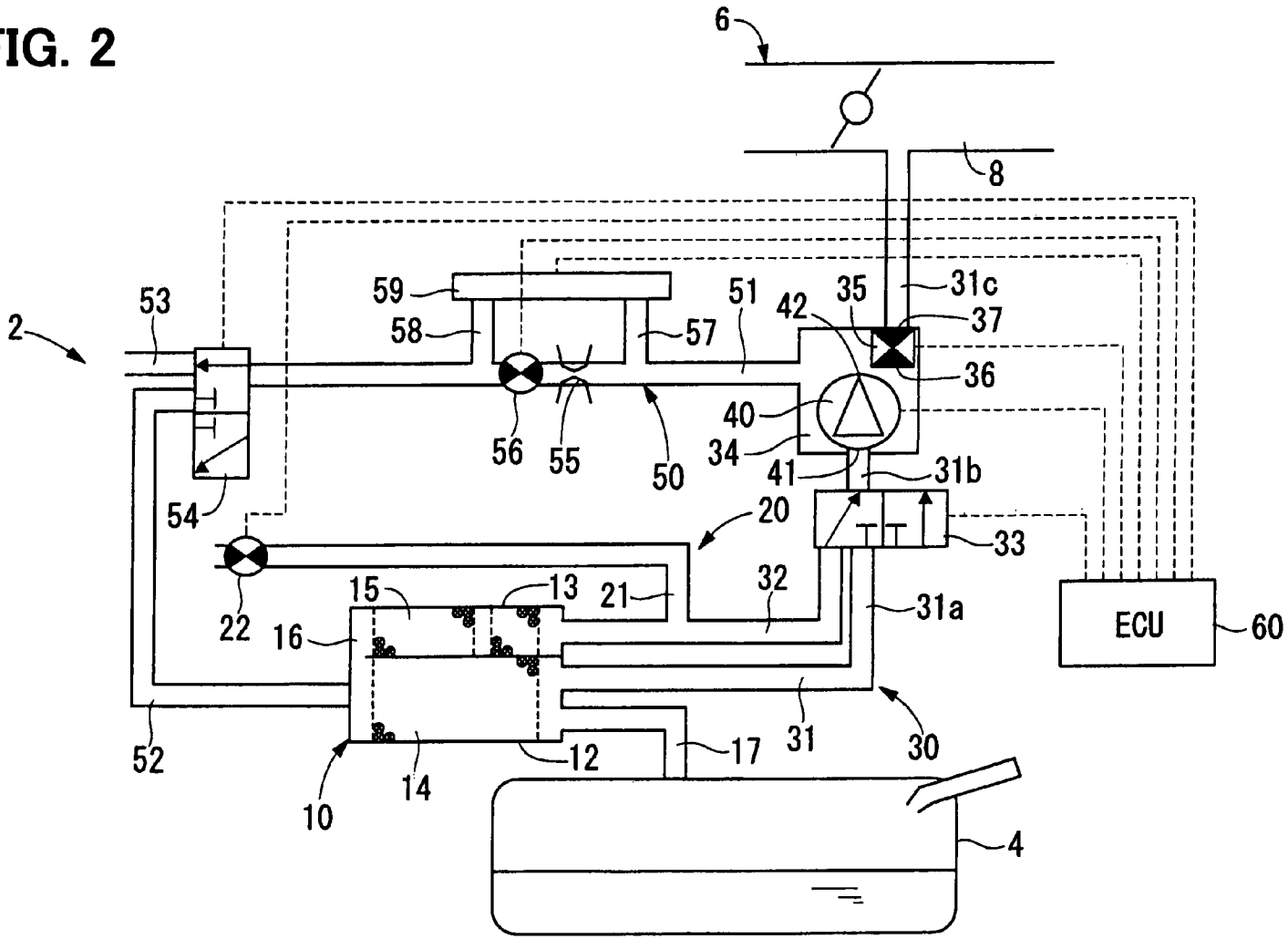
FIG. 2 is a structural diagram showing the fuel vapor treatment apparatus where operating conditions of valves are different from those in FIG. 1.

The atmospheric release control system 20 includes the first atmosphere passage 21, an atmospheric release control valve 22 and the like. The first atmosphere passage 21 includes the atmospheric release control valve 22 which is open to an atmosphere at an opposing end side to the canister 10. The atmospheric release control valve 22 is a two-way valve of an electric drive type and opens/closes the first atmosphere passage 21. Accordingly, in a state where the atmospheric release control valve 22 is open as shown in FIG. 1, the inside of the canister 19 is open to an atmosphere through the first atmosphere passage 21 and in a state where the atmospheric release control valve 22 is closed as shown in FIG. 2, the inside of the canister 10 is closed to an atmosphere.

The purging system 30 includes the purging passage 31, a second atmosphere passage 32, a first switching valve 33, a volume chamber 34, a purge control valve 35 and the like, as shown in FIG. 1.

The purging passage 31 is communicated with an intake passage 8 for the engine 6 at an opposing end to the canister 10 and is provided with the first switching valve 33 and the volume chamber 34. Thereby, the purging passage 31 is divided into a first passage part 31*a* between the canister 10 and the first switching valve 33, a second passage part 31*b* between the first switching valve 33 and the volume chamber 34 and a third passage part 31*c* between the volume chamber 34 and the intake passage 8. One end of the second atmosphere passage 32 is communicated between the atmospheric release control valve 22 in the first atmosphere passage 21 and the canister 10, and the other end of the second atmosphere passage 32 is connected to the first switching valve 33. The first switching valve 33 is a three-way valve of an electromagnetic drive type and switches a passage communicating with the second passage part 31*b* to the first passage part 31*a* or to the second atmosphere passage 32. Accordingly, as shown in FIG. 1, in the first state of the first switching valve 33 communicating the first passage part 31*a* with the second passage part 31*b*, the fuel vapor desorbed from the canister 10 is to flow into the volume chamber 34 through the first and second passage parts 31*a* and 31*b* in that order. On the other hand, as shown in FIG. 2, in the second state of the first switching valve 33 communicating the second atmosphere passage 32 with the second passage part 31*b*, the inside of the volume chamber 34 is open to an atmosphere through the first atmosphere passage 21, the second atmosphere passage 32 and the second passage parts 31*b*.

The volume chamber 34 is, as shown in FIG. 1, designed to have a cross section larger than that of each of the second and third passage parts 31*b* and 31*c* in the purging passage 31, thus securing an enlarged passage volume to the each of the passage parts 31*b* and 31*c*. The volume chamber 34 receives the purge control valve 35 therein which is a two-way valve of an electromagnetic drive type. A fluid inlet 36 of the purge control valve 35 is open to the inside of the volume chamber 34 and a fluid outlet 37 of the purge control valve 35 is communicated with the third passage part 31*c*. In a state where the purge control valve 35 is open as shown in FIG. 1, the volume chamber 34 is communicated with the intake passage 8 through the third passage part 31*c*. On the other hand, in a state where the purge control valve 35 is closed as shown in FIG. 2, the communication between the volume chamber 34 and the intake passage 8 is blocked.

The pump 40 is of an electric type and is received in the volume chamber 34 as shown in FIG. 1. A suction port 41 of the pump 40 is communicated with the second passage part 31*b* and a discharge port 42 of the pump 40 is open to the inside of the volume chamber 34 in a state of being not oriented in the direction of the fluid inlet 36 of the purge control valve 35. The pump 40 sucks in the fluid from the second passage part 31*b* and pressurizes the sucked fluid, which is discharged into the inside of the volume chamber 34.

The detection system 50 includes a detection passage 51, a return passage 52, a third atmosphere passage 53, a second switching valve 54, an orifice 55, an opening/closing control valve 56, a first and second pressure-introducing passages 57 and 58, a pressure sensor 59 and the like.

One end of the detection passage 51 is communicated with the volume chamber 34 and the other end thereof is connected to the second switching valve 54. One end of the return passage 52 is communicated with the communicating space 16 in the canister 10 and the other end thereof is connected to the second switching valve 54. One end of the third atmosphere passage 53 is open to an atmosphere and the other thereof is connected to the second switching valve 54. The second switching valve 54 is a three-way valve of an electromagnetic drive type and switches a passage communicated with the detection passage 51 to the return passage 52 or to the third atmosphere passage 53. Accordingly, as shown in FIG. 1, in a first state of the second switching valve 54 communicating with the return passage 52 with the detection passage 51, the fuel vapor flown from a concentration measurement process to be described later into the detection passage 51 returns into the canister 10 via the return passage 52. On the other hand, as shown in FIG. 2, in a second state of the second switching valve 54 communicating the third atmosphere passage 53 with the detection passage 51, the detection passage 51 is open to an atmosphere.

The orifice 55 is, as shown in FIG. 1, provided in the middle of the detection passage 51 for throttling a cross-sectional area of the detection passage 51. The opening/closing control valve 56 is a two-way valve of an electromagnetic drive type and is provided between the orifice 55 and the second switching valve 54 in the detection passage 51. The first pressure-introducing passage 57 is communicated between the volume chamber 34 and the orifice 55 in the detection passage 51. The second pressure-introducing passage 58 is communicated between the opening/closing control valve 56 and the second switching valve 54 in the detection passage 51. The pressure sensor 59 is, in the first embodiment, a differential pressure sensor and is connected to each of the pressure-introducing passages 57 and 58. The pressure sensor 59 detects a differential pressure between a pressure received through the first pressure-introducing passage 57 and a pressure received through the second pressure-introducing passage 58. Accordingly, in the opening state of the opening/closing control valve 56 and in the first state of the second switching valve 54 as shown in FIG. 1, a differential pressure between both ends of the orifice 55 produced when the fluid passes through the orifice 55 is detected by the pressure sensor 59. On the other hand, in the closing state of the opening/closing control valve 56 and in the second state of the second switching valve 54 as shown in FIG. 2, a differential pressure between a pressure in the detection passage 51 at the side of the volume chamber 34 from the orifice 55 and an atmospheric pressure is detected by the pressure sensor 59.

The ECU 60 is composed mainly of a microcomputer having a CPU and a memory and is, as shown in FIG. 1, connected electrically to valves 22, 33, 35, 54 and 56, the pump 40 and the pressure sensor 59. The ECU 60 controls the valves 22, 33, 35, 54 and 56, and the pump 40 based upon, for example, the detection result of the pressure sensor 59, a cooling water temperature of the engine 6, an operating oil temperature of a vehicle, a rotational speed of the engine 6, an accelerator position of the vehicle, an on/off state of an ignition switch and the like. The ECU 60 also includes a control function, such as an air-fuel ratio control for the engine 6.

Next, the concentration measurement process of the fuel vapor treatment apparatus 2 will be explained with reference to a flow chart in FIG. 3.

The concentration measurement process starts when a concentration measurement condition is fulfilled after startup of the engine 6. "The fulfillment of the concentration measurement condition" means that a physical quantity representing a vehicle condition such as a cooling water temperature of the engine 6, an operating oil temperature of a vehicle, or a rotational speed of the engine 6 is within a predetermined range. At the time of starting the concentration measurement process, it is assumed that the purge control valve 35 is in the closing state, the first and second switching valves 33 and 54 are in the second state, the atmospheric release control valve 22 and the opening/closing control valve 56 are in the open state and the pump 40 is in the stop state.

Figures 3, 4:
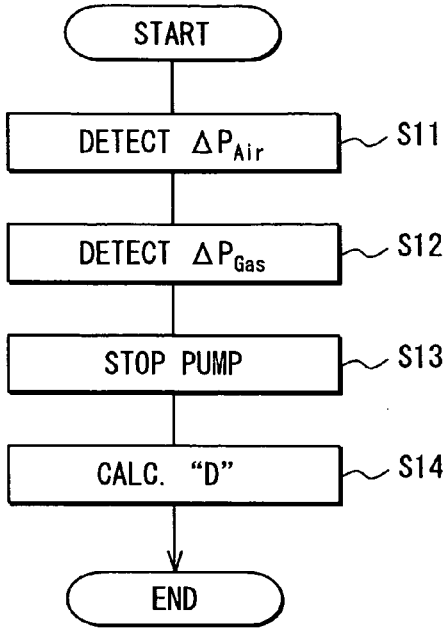
FIG. 3 is a flow chart showing a concentration measurement process of the fuel vapor treatment apparatus in FIG. 1.
FIG. 4 is a table for explaining operations of the fuel vapor treatment apparatus in FIG. 1.
Figure 5:
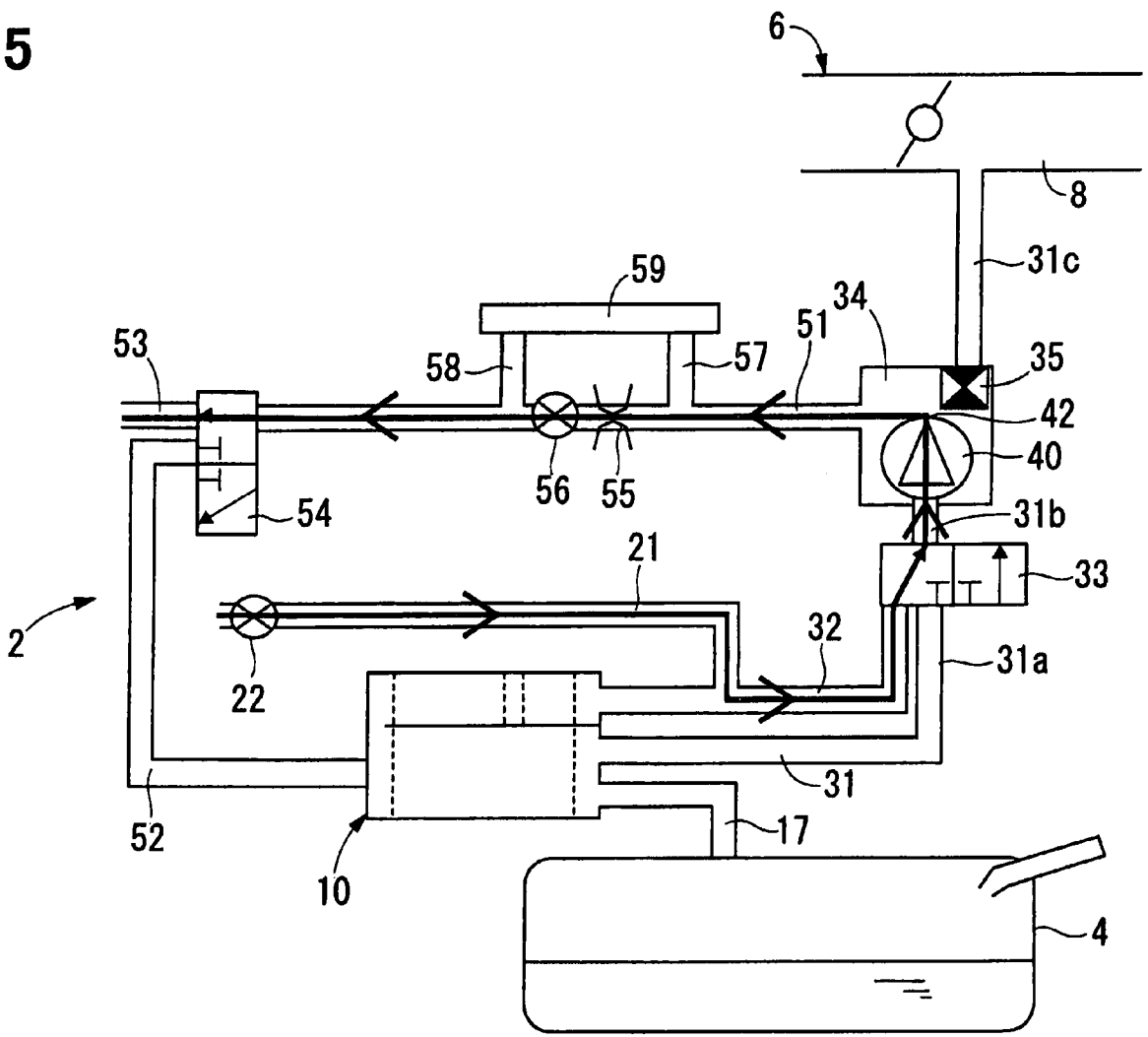
FIG. 5 is a diagram for explaining the concentration measurement process in FIG. 3.
Figure 6:
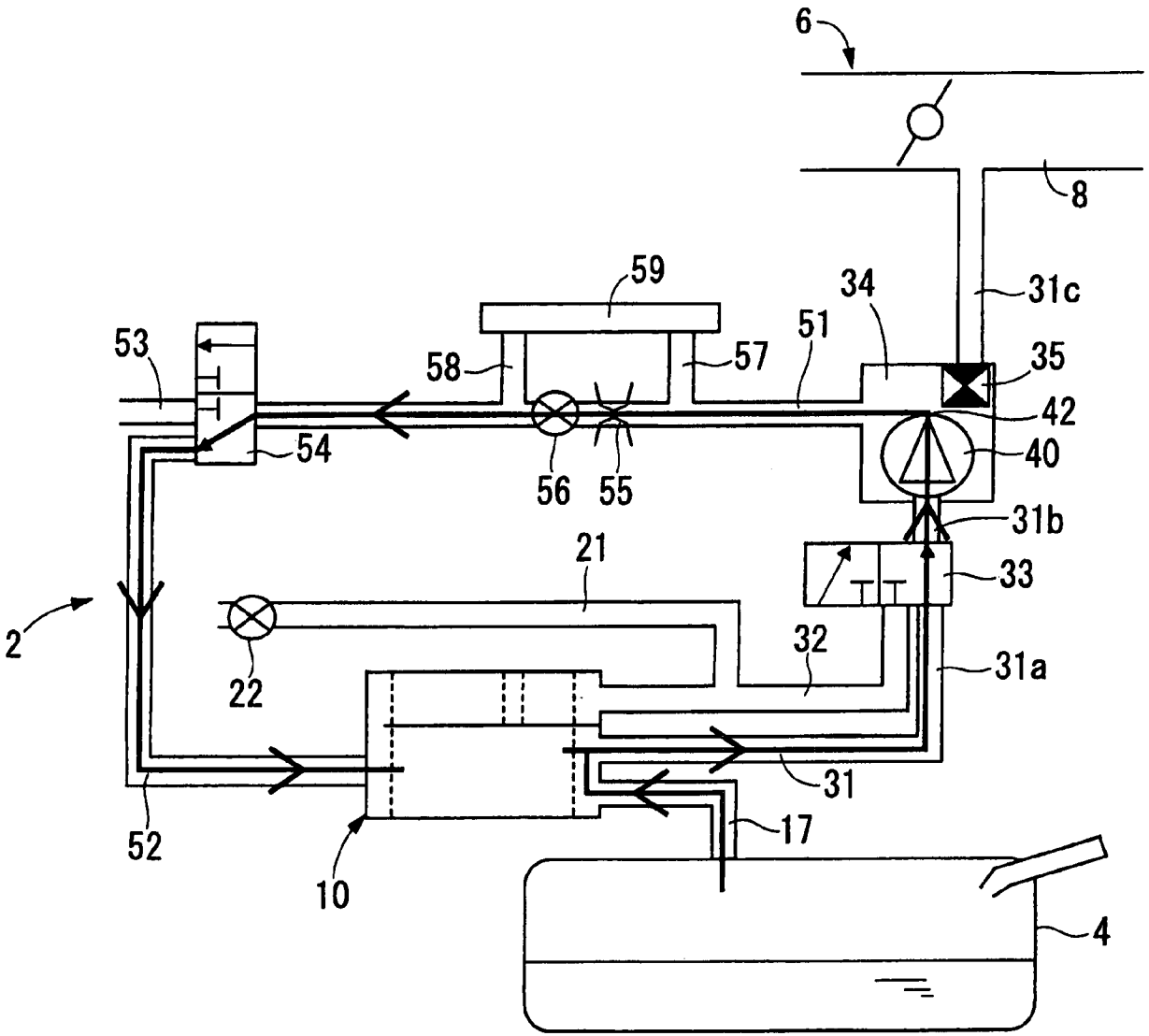
FIG. 6 is a diagram for explaining the concentration measurement process in FIG. 3.

At step S11 of the concentration measurement process, the ECU 60, as shown in FIG. 4, activates the pump 40 to control the rotational speed at a constant value while keeping each valve 22, 33, 35, 54 and 56 at the state at the time of starting the process. Thereby, air is, as shown in FIG, 5, sucked in from the first atmosphere passage 21 through the second atmosphere passage 32 and the second passage part 31*b* in the purging passage 31 to the pump 40, further is discharged from the pump 40 to the inside of the volume chamber 34, and then flows into the detection passage 51. As a result, since the differential pressure between both ends of the orifice 55 changes to a predetermined value, at step S11 a stable value of the detected differential pressure by the pressure sensor 59 is stored as a differential pressure $\Delta P_{Air}$ in a memory of the ECU 60. In the first embodiment, the pressure loss generated through the canister 10, the tank passage 17 and the fuel tank 4 is greater than the pressure loss in the first atmosphere passage 21, and therefore, fuel desorption from the canister 10 to the first atmosphere passage 21 is prevented.

At subsequent step S12, the ECU 60, as shown in FIG. 4, switches the first and second switching valves 33 and 54 to the first state while keeping the valves 22, 35 and 56, and the pump 40 at the state at the time of executing step S11. Thereby, the desorbed fuel from the canister 10 and the fuel vapor from the fuel tank 4 are sucked in to the pump 40 via the first and second passage parts 31*a* and 31*b* in the purging passage 31, further discharged from the pump 40 to the inside of the volume chamber 34 and then, flow into the detection passage 51. As a result, since a differential pressure between both ends of the orifice 55 changes to a value in accordance with the fuel vapor concentration in the detection passage 51, at step S12 a stable value of the detected differential pressure by the pressure sensor 59 is stored as a differential pressure $\Delta P_{Gas}$ in the memory of the ECU 60

At subsequent step S13 the ECU 60 stops the pump 40. Thereafter, at step S14 the ECU 60 reads out the differential pressures $\Delta P_{Air}$ and $\Delta P_{Gas}$ stored in the memory at step S11 and step S12, the fuel vapor concentration in the detection passage 51 is calculated based upon these values. This calculated fuel vapor concentration D is stored in the memory of the ECU 60 and is used in the purging process to be described later.

In the above concentration measurement process, at step S12 the fuel vapor flows from the second passage part 31*b* of the purging passage 31 via the pump 40 into the volume chamber 34 enlarged in volume. Thereby, since the fuel vapor is diffused inside the volume chamber 34, the concentration of the fuel vapor is diluted. Therefore, even if the fuel vapor concentration in the second passage part 31*b* at the upstream side of the volume chamber 34 changes with time in response to a remaining fuel adsorption quantity in the canister 10, a fuel vapor quantity inside the fuel tank 4 or the like, the quantity of the fuel vapor concentration in the volume chamber 34 changing with time is averaged. Therefore, the fuel vapor concentration in the detection passage 51 at the downstream side of the volume chamber 34 is stable. Yet since a flow of the fuel vapor flown into the volume chamber 34 is forcibly generated by the pump 40, stabilization of the fuel vapor concentration is facilitated. Such stabilization function of the fuel vapor concentration allows a differential pressure $\Delta P_{Gas}$ in correlation with the fuel vapor concentration to be detected for a short time at step S12, making it possible to shorten the time required for the concentration measurement process.

Since the pump 40 operating in the concentration measurement process at step S11 and step S12 is received-inside the volume chamber 34, an operating sound of the pump 40 can be blocked by the walls of the volume chamber 34. Further, since the discharge port 42 of the pump 40 is open in the inside of the volume chamber 34, the pressure fluctuation generated inside the operating pump 40 is damped inside the volume chamber 34, thereby avoiding the pressure fluctuation to cause vibrations of the walls in the volume chamber 34 and the purging passage 31, and the canister 10. The blocking function of the operating sound and the damping function of the pressure fluctuation thus allows generation of noises to be restricted.

Figure 7:
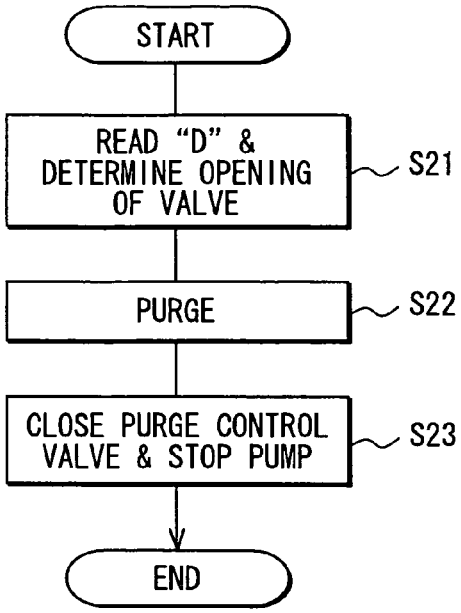
FIG. 7 is a flow chart showing a purging process of the fuel vapor treatment apparatus in FIG. 1.

Next, the purging process in the fuel vapor treatment apparatus 2 will be explained with reference to a flow chart in FIG. 7.

The purging process starts when a purge start condition is fulfilled during operating of the engine 6 after the execution of the concentration measurement process. "The fulfillment of the purge start condition" means that a physical quantity representing a vehicle condition such as a cooling water temperature of the engine 6, a rotational speed of the engine 6 or an operating oil temperature of a vehicle is within a range different from that in the above concentration measurement condition. At the time of starting the purging process, it is assumed that the purge control valve 35 is in the closing state, the first and second switching valves 33 and 54 are in the first state, the atmospheric release control valve 22 and the opening/closing control valve 56 are in the open state and the pump 40 is in the stop state.

At step S21 of the purging process control, the ECU 60 reads out the fuel vapor concentration D stored in the memory at step S14 of the concentration measurement process immediately before the purging process from the memory and determines an opening of the purge control valve 35 based upon the concentration D.

Figure 8:
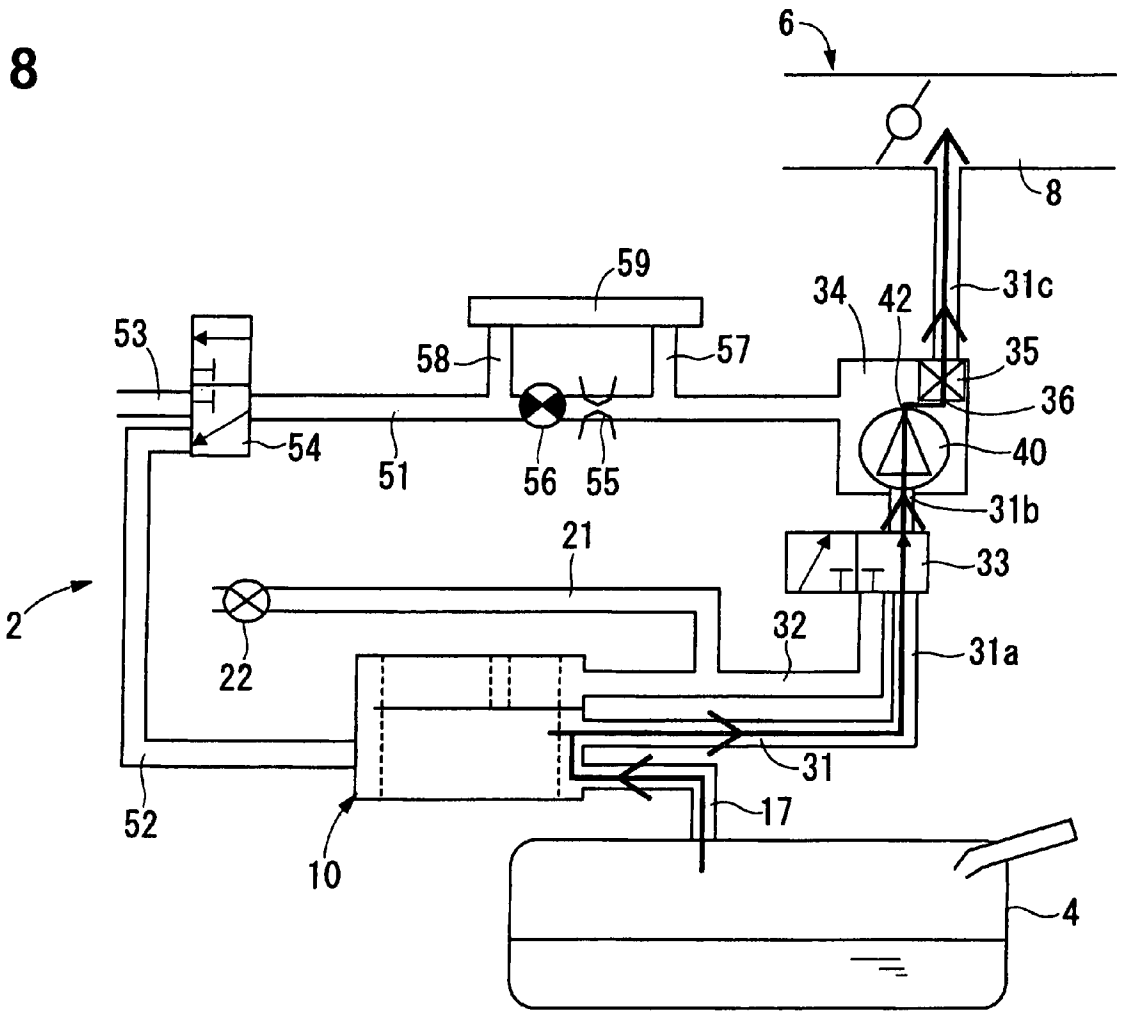
FIG. 8 is a diagram for explaining the purging process in FIG. 7.
Figure 10:
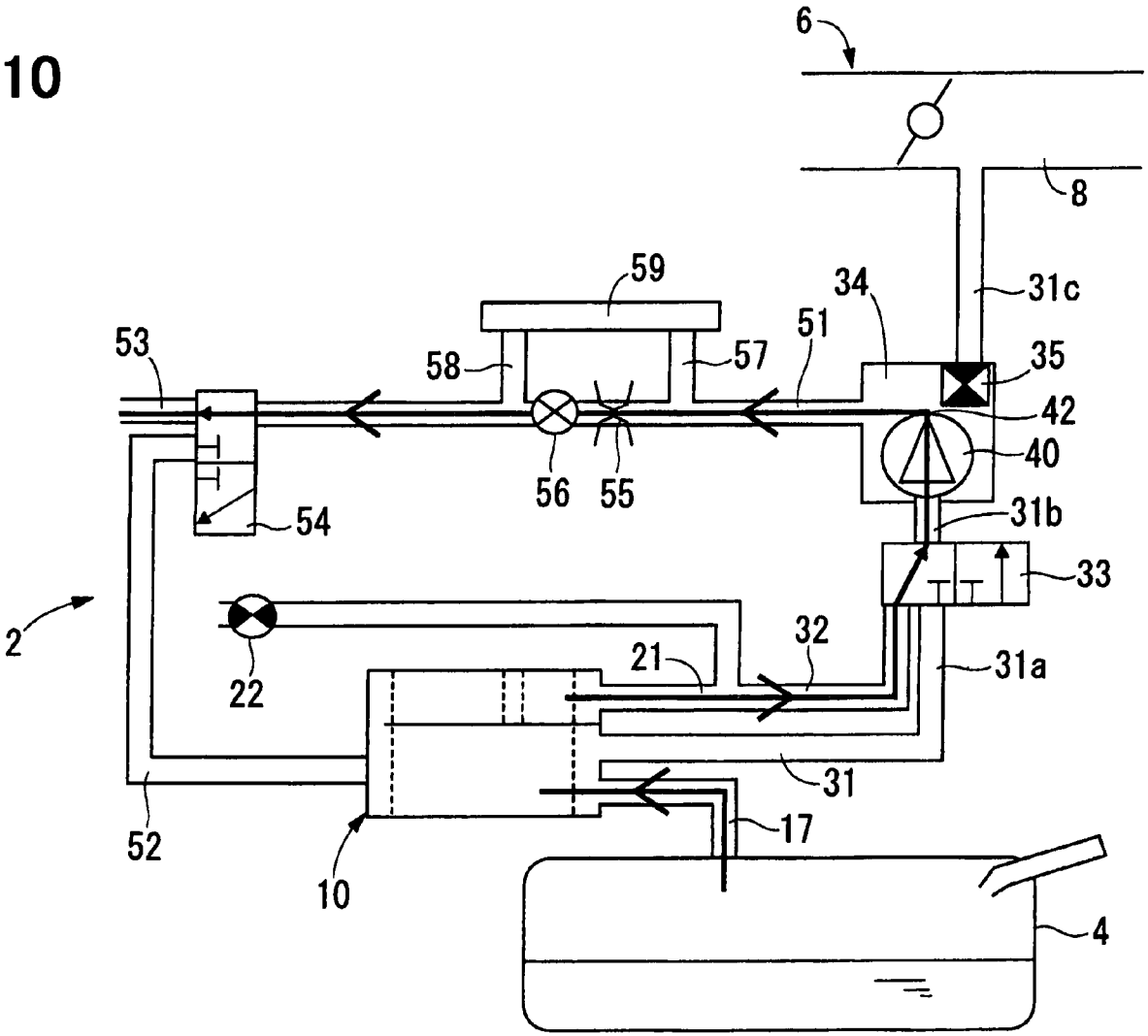
FIG. 10 is a diagram for explaining a leakage inspection process in FIG. 9.

At subsequent step S22, the ECU 60, as shown in FIG. 4, opens the purge control valve 35 at the opening determined at step S21 and also closes the opening/closing control valve 56 while keeping the state of the valves 22, 33 and 54 at the time of starting the purging process. Further, at step S22 the ECU 60 activates the pump 40 to control the rotational speed at a constant value. Thereby, the desorbed fuel from the canister 10 and the fuel vapor from the fuel tank 4 are, as shown in FIG. 8, sucked in to the pump 40 via the first and second passage parts 31*a* and 31*b* of the purging passage 31, and further discharged from the pump 40 to the inside of the volume chamber 34. As a result, the fuel vapor is forcibly purged via the third passage part 31*c* of the purging passage 31 into the intake passage 8. At this point, a flow quantity or a pressure of the fuel vapor to be purged is controlled by an opening of the purge control valve 35.

When the purge stop condition is fulfilled during forcible purging of the fuel vapor, at step S23 the ECU 60 closes the purge control valve 35 and also stops the pump 40. "The fulfillment of the purge stop condition" means that a physical quantity representing a vehicle condition such as a rotational speed of the engine 6 or an accelerator position of a vehicle is within a range different from that in each of the above concentration measurement condition and the above purge start condition.

In the above purging process, at step S22 the fuel vapor flows from the second passage part 31*b* of the purging passage 31 via the pump 40 into the volume chamber 34 enlarged in volume. Thereby, the fuel vapor concentration is diffused inside the volume chamber 34 the same as in the case of the concentration measurement process. Therefore, even if the fuel vapor concentration in the second passage part 31*b* at the upstream side of the volume chamber 34 changes with time, the fuel vapor concentration in the volume chamber 34 changing with time is averaged. Therefore, the fuel vapor concentration in the third passage part 31*c* of the purging passage 31 at the downstream side of the volume chamber 34 is stable. Yet since a flow of the fuel vapor flown into the volume chamber 34 is forcibly generated by the pump 40, stabilization of the fuel vapor concentration is facilitated. Such stabilization function of the fuel vapor concentration results in stabilization of the purge concentration to the intake passage 8, making an air-fuel ratio control of the engine 6 by the ECU 60 easy.

Further, since the purge control valve 35 opening/closing at step S22 and at step S23 in the purging process and the pump 40 operating at step S22 are received inside the volume chamber 34, an operating sound of the purge control valve 35 or the pump 40 can be blocked by the walls of the volume chamber 34. Further, since the fluid inlet 36 of the purge control valve 35 is open in the inside of the volume chamber 34, the pressure fluctuation generated inside the purge control valve 35 due to the opening/closing thereof is damped inside the volume chamber 34, thereby avoiding the pressure fluctuation to cause vibrations of the walls in the volume chamber 34 and the purging passage 31, and the canister 10. Furthermore, since a discharge port 42 of the pump 40 is open in the inside of the volume chamber 34, the pressure fluctuation generated inside the pump 40 is damped the same as in the case of the concentration measurement process, thereby avoiding the state where the pressure fluctuation causes vibrations. The blocking function of the operating sound and the damping function of the pressure fluctuation thus allow generation of noises to be restricted.

Figure 9:
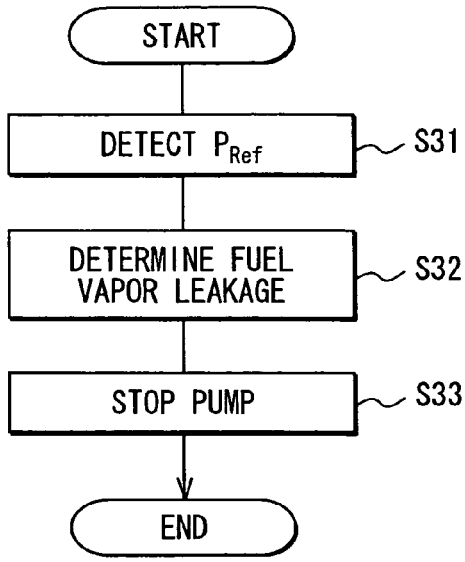
FIG. 9 is a flow chart showing a leakage inspection process of the fuel vapor treatment apparatus in FIG. 1.

Next, the leakage inspection process of the fuel vapor treatment apparatus 2 will be explained with reference to a flow chart in FIG. 9.

The leakage inspection process starts after the engine 6 has stopped. At the time of starting the leakage inspection process, it is assumed that the purge control valve 35 is in the closing state, the first and second switching valves 33 and 54 are in the first state, the atmospheric release control valve 22 and the opening/closing control valve 56 are in the open state and the pump 40 is in the stop state.

At step S31 of the leakage inspection process, the ECU 60, as shown in FIG. 4, switches the first and second switching valves 33 and 54 to the second state and also closes the atmospheric release control valve 22 while keeping the valves 35 and 56 at the state at the time of starting the process. Further, at step S31 the ECU 60 activates the pump 40 to control the rotational speed at a constant value. Thereby, the fuel vapor, as shown in FIG, 10, from the fuel tank 4 is introduced into the canister 10 and at the same time the desorbed fuel from the canister 10 is sucked in to the pump 40 via the first and second atmosphere passages 21 and 32 and the second passage part 31*b* of the purging passage 31. The fuel vapor sucked in to the pump 40 is discharged to the inside of the volume chamber 34, and then flows into the detection passage 51 form the volume chamber 34. As a result, since the differential pressure between both ends of the orifice 55 changes to a value in accordance with the cross section of the orifice 55, at step S31 a stable value of the detected differential pressure by the pressure sensor 59 is stored as a reference pressure $P_{Ref}$ in the memory of the ECU 60.

Figure 11:
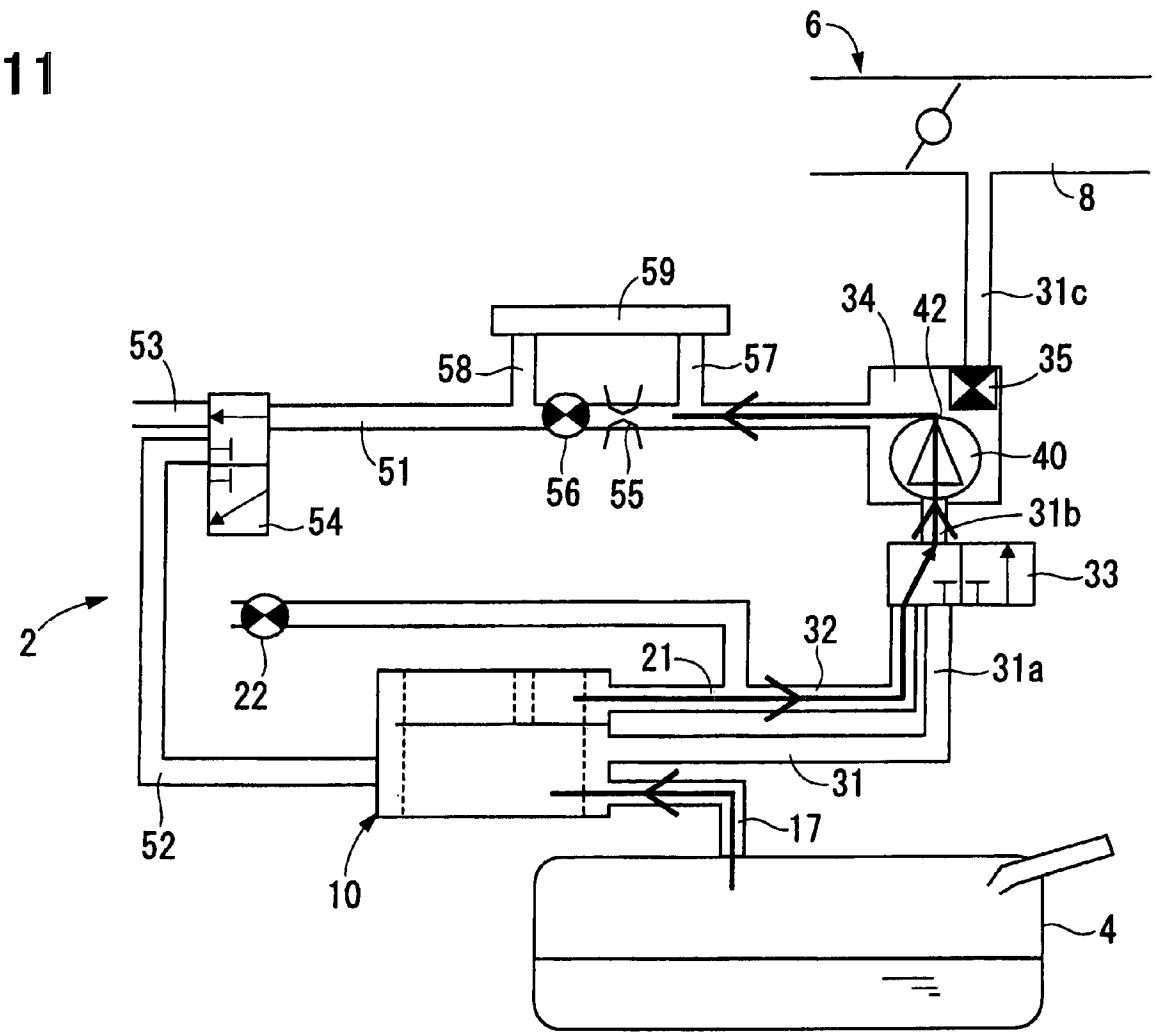
FIG. 11 is a diagram for explaining the leakage inspection process in FIG. 9.

When the detection of the reference pressure $P_{Ref}$ is completed, at step S32, the ECU 60, as shown in FIG. 4, closes the opening/closing control valve 56 while keeping the valves 22, 33, 35 and 54, and the pump 40 at the state at the time of executing step S31. Thereby, the fuel vapor from the fuel tank 4 is, as shown in FIG. 11, introduced into the canister 10 and at the same time, the desorbed fuel from the canister 10 is sucked in to the pump 40 via the first and second atmosphere passages 21 and 32 and the second passage part 31*b* of the purging passage 31. The fuel vapor sucked into the pump 40 is discharged to the inside of the volume chamber 34 and then, flows from the volume chamber 34 into the detection passage 51. As a result, since a differential pressure between a pressure in the detection passage 51 at the side of the volume chamber 34 from the orifice 55 and an atmospheric pressure changes in accordance with an open area of the fuel tank 4, the canister 10, or the like. Then, at step S32 the detected differential pressure by the pressure sensor 59 is compared to the reference pressure $P_{Ref}$ stored in the memory of the ECU 60 at step S31 to determine the fuel vapor leakage from an open port of the fuel tank 4, the canister 10 or the like.

When the determination as to the fuel vapor leakage is completed, at step S33 the ECU 60 stops the pump 40.

Since at step S31 and step S32 in the above leakage inspection process, the pump 40 operates inside the volume chamber 34, an operating sound of the pump 40 can be blocked by the walls of the volume chamber 34. Further, since the discharge port 42 of the pump 40 is open in the inside of the volume chamber 34, the pressure fluctuation generated inside the operating pump 40 is damped the same as in the case of the concentration measurement process, thereby avoiding the state where the pressure fluctuation causes vibrations. The blocking function of the operating sound and the damping function of the pressure fluctuation thus allow generation of noises to be restricted.

Second Embodiment

Figure 12:
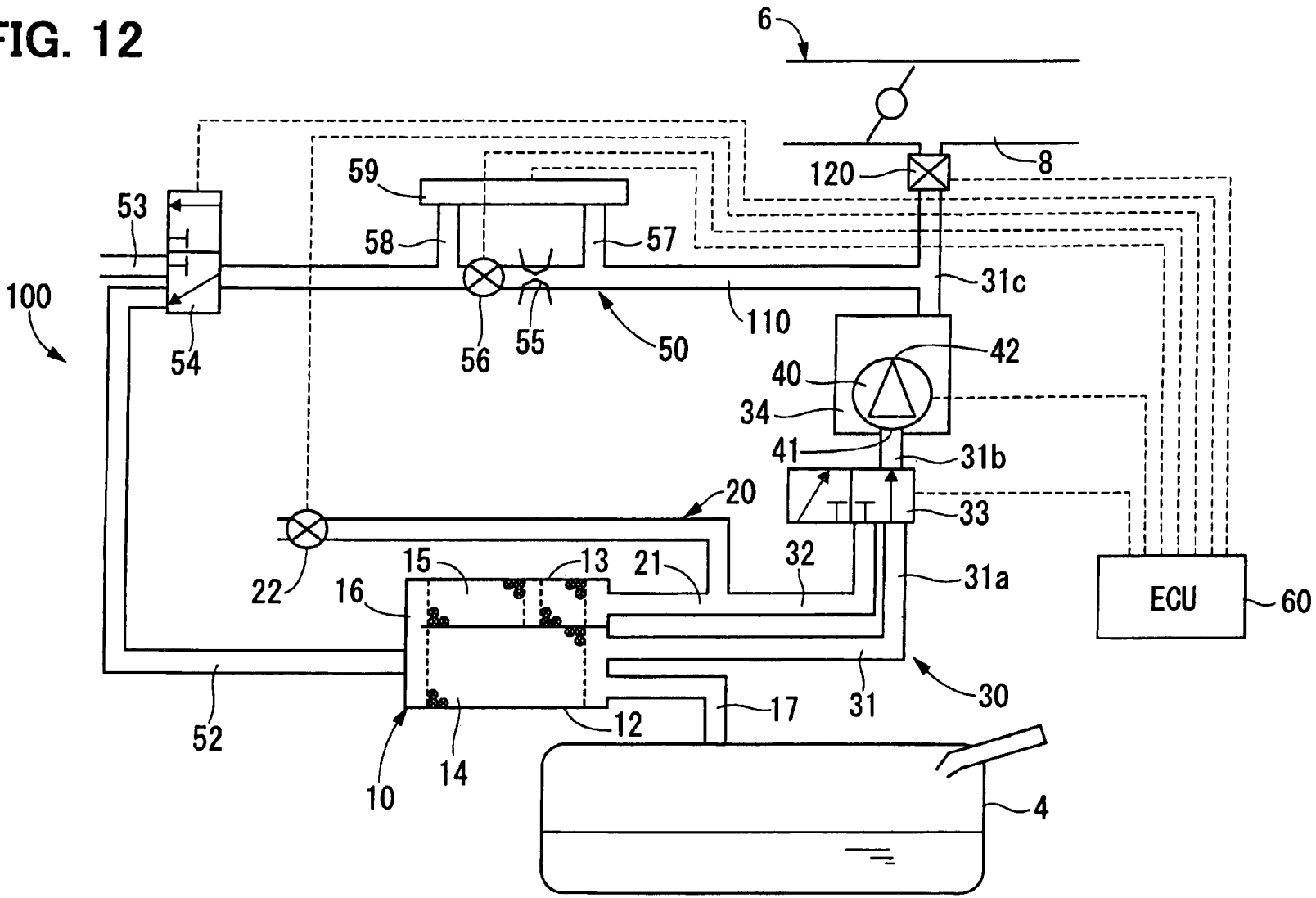
FIG. 12 is a structural diagram showing a fuel vapor treatment apparatus in a second embodiment of the present invention.

As shown in FIG. 12, a second embodiment shows a modification of the first embodiment.

More specially, in a fuel vapor treatment apparatus 100 of the second embodiment, a detection passage 110 is communicated with the third passage part 31*c* in the purging passage 31 located at the downstream side of the volume chamber 34 and the purge control valve 120 is provided in the third passage part 31*c* placed outside of the volume chamber 34.

In the second embodiment, the concentration measurement process, the purging process and the leakage inspection process similar to those in the first embodiment are executed. Therefore, at the time of executing each process, generation of noises due to the operation of the pump 40 can be restricted.

According to the second embodiment, in the purging passage 31 the purge control valve 35 is designed to be located at an opposing side to the canister 10 in such a way as to sandwich the volume chamber 34. Therefore, the pressure fluctuation generated inside the purge control valve 120 by the opening/closing thereof is damped inside the volume chamber 34 before transmitted to the canister 10, thus avoiding the state where the pressure fluctuation causes noises.

Third Embodiment

Figure 13:
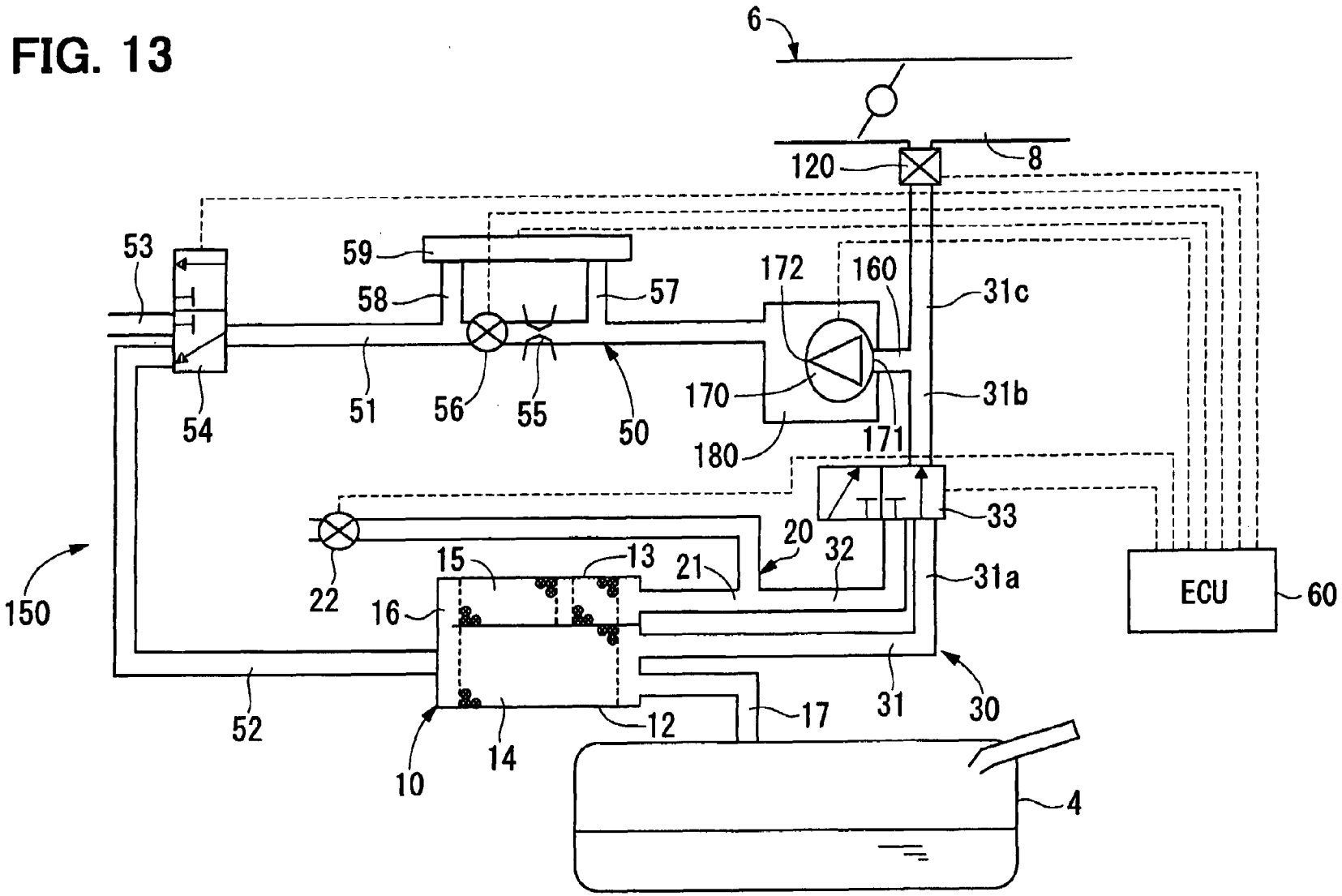
FIG. 13 is a structural diagram showing a fuel vapor treatment apparatus in a third embodiment of the present invention.

As shown in FIG. 13, a third embodiment shows a modification of the second embodiment.

More specially, in a fuel vapor treatment apparatus 150 of the third embodiment, the second and third passage parts 31*b* and 31*c* of the purging passage 31 are directly communicated to each other and a detection passage 160 is communicated with the boundary part between the second and third passage parts 31*b* and 31*c*. Further, a volume chamber 180 for receiving a pump 170 therein is provided in the detection passage 160 between the purging passage 31 and the first pressure-introducing passage 57. The volume chamber 180 has a cross section greater than that of the detection passage 160 as shown in FIG. 13 to secure a passage volume enlarged to the detection passage 160. A suction port 171 of the pump 170 is communicated at the side of the purging passage 31 from the volume chamber 180 with the detection passage 160 and a discharge port 172 of the pump 170 is open in the inside of the volume chamber 180 in a state of being not oriented in the direction of the first pressure-introducing passage 57 from the volume chamber 180 in the detection passage 160. The pump 170 sucks in the fluid from the side of the purging passage 31 in the detection passage 160 to the volume chamber 180 and pressurizes the sucked fluid, which is discharged into the inside of the volume chamber 180.

Figure 14:
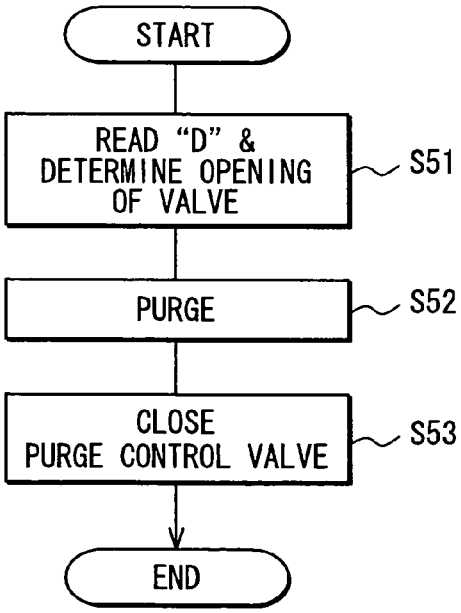
FIG. 14 is a flow chart showing a purging process of the fuel vapor treatment apparatus in FIG. 13.

In the third embodiment, the concentration measurement process and the leakage inspection process similar to those in the first embodiment are executed and on the other hand, the purging process different from that in the first embodiment is executed. That is, in the purging process of the third embodiment as shown in FIG. 14, at step S52 instead of at step S22 in the first embodiment, the ECU 60 does not activate the pump 170, but maintains it as it is at the stop state. This causes an intake vacuum in the intake passage 8 to act on the canister 10 through the purging passage 31 and therefore, the desorbed fuel from the canister 10 and the fuel vapor from the fuel tank 4 are purged to the intake passage 8 via the purging passage 31. When the purge stop condition is fulfilled during the purging, at step S53 instead of step S23 in the first embodiment, the ECU 60 closes the purging control valve 120. Step S51 in the purging process of the third embodiment is similar to step S21 in the first embodiment.

According to the third embodiment as described above, the concentration measurement process similar to that in the first embodiment is executed, thereby shortening the process time. In addition, at the time of executing such concentration measurement process and the leakage inspection process similar to that in the first embodiment, generation of noises due to an operation of the pump 170 can be restricted.

Fourth Embodiment

Figure 15:
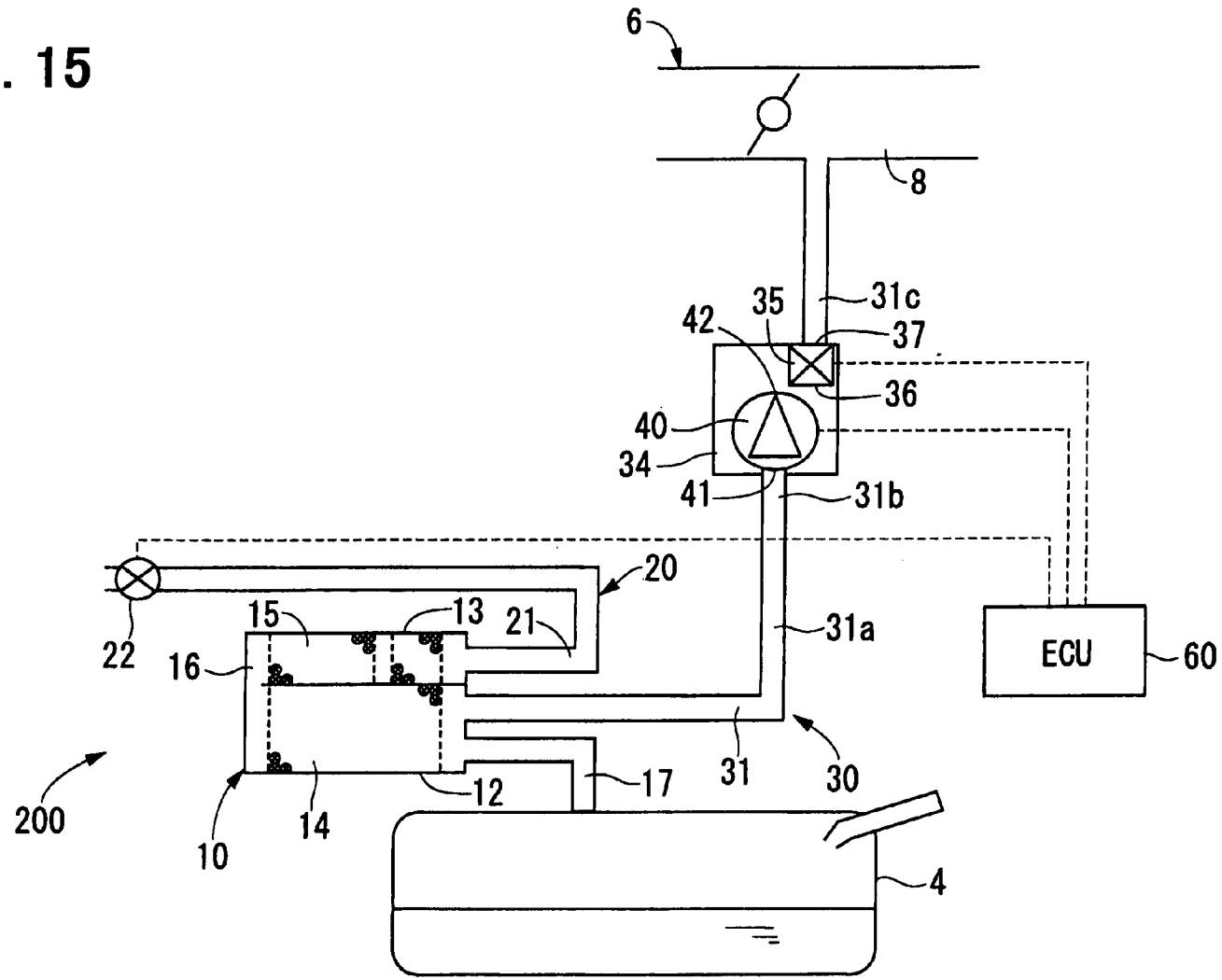
FIG. 15 is a structural diagram showing a fuel vapor treatment apparatus in a fourth embodiment of the present invention.

As shown in FIG. 15, a fourth embodiment shows a modification of the first embodiment.

More specially, in a fuel vapor treatment apparatus 200 of the fourth embodiment, the second atmosphere passage 32, the first switching valve 33 and the detection system 50 are not provided. In such fourth embodiment, the purging process similar to that in the first embodiment is executed, thereby implementing stabilization of the purging concentration to make the air-fuel ratio control of the engine 6 easy. In addition, at the time of executing the purging process, generation of noises due to operations of the purge control valve 35 and the pump 40 can be restricted.

As described above, the plural embodiments of the present invention are explained, but the present invention is not construed as limited to the embodiments and can be applied to various embodiments within the scope without departing from the spirit thereof.

For example, in the above first to fourth embodiments, an absolute sensor for detecting a pressure received through the second pressure-introducing passage 58 may be used as the pressure sensor 59 without provision of the first pressure-introducing passage 57. In addition, in the above first to fourth embodiments, a relative pressure sensor for detecting a relative pressure to an atmospheric pressure of a pressure received through the second pressure-introducing passage 58 may be used as the pressure sensor 59 without provision of the first pressure-introducing passage 57. Furthermore, in the above first to fourth embodiments, an absolute sensor for detecting a pressure received through the first pressure-introducing passage 57 and an absolute sensor for detecting a pressure received through the second pressure-introducing passage 58 may be used instead of the pressure sensor 59 to calculate a differential pressure between the detection pressures of the absolute sensors by the ECU 60.

Further, in the first to fourth embodiments, the purging passage 31 may be communicated directly with the fuel tank 4.

In addition, in the first and fourth embodiments, similarly to the second embodiment, the purge control valve 35 may be provided in the third passage part 31*c* of the purging passage 31 as placed in the outside of the volume chamber 34.

Further, in the first embodiment, the second embodiment and the fourth embodiment, in the purging process a rotational speed of the pump 40 may be controlled, thus controlling a flow quantity or a pressure of the fuel vapor to be purged.

While only the selected example embodiments have been chosen to illustrate the present invention, it will be apparent to those skilled in the art from this disclosure that various changes and modifications can be made therein without departing from the scope of the invention as defined in the appended claims. Furthermore, the foregoing description of the example embodiments according to the present invention is provided for illustration only, and not for the purpose of limiting the invention as defined by the appended claims and their equivalents.

What is claimed is:

1. A fuel vapor treatment apparatus comprising:

a purging passage for introducing and purging fuel vapor produced in a fuel tank to an intake system for an internal combustion engine;

a volume chamber provided in the purging passage for enlarging a passage volume;

a pump received in the volume chamber for generating a fluid flow in the purging passage;

a detection passage communicating with the volume chamber;

detecting means which detects a physical quantity in correlation with a fuel vapor concentration in the detection passage; and calculating means which calculates a fuel vapor concentration in the purging passage based upon the physical quantity detected by the detecting means.

2. A fuel vapor treatment apparatus according to claim 1, further comprising:

a canister communicating with the fuel tank and the purging passage, wherein:

the canister includes an adsorbing material for adsorbing the fuel vapor produced in the fuel tank in such a way as to be desorbed to the purging passage.

3. A fuel vapor treatment apparatus according to claim 1, further comprising:

a purge control valve received in the volume chamber for controlling purge of the fuel vapor to the intake system.

4. A fuel vapor treatment apparatus according to claim 3, wherein:

the purge control valve includes a fluid inlet which is open in an inside of the volume chamber.

5. A fuel vapor treatment apparatus according to claim 1, wherein:

the physical quantity detected by the detecting means includes a pressure in the detection passage.

6. A fuel vapor treatment apparatus according to claim 1, wherein:

the pump includes a discharge port which is open in an inside of the volume chamber.

7. A fuel vapor treatment apparatus comprising:

a purging passage for introducing and purging fuel vapor produced in a fuel tank to an intake system for an internal combustion engine;

a volume chamber provided in the purging passage for enlarging a passage volume;

a pump received in the volume chamber for generating a fluid flow in the purging passage;

a detection passage communicating with the purging passage at the downstream side of the volume chamber;

detecting means which detects a physical quantity in correlation with a fuel vapor concentration in the detection passage; and calculating means which calculates a fuel vapor concentration in the purging passage based upon the physical quantity detected by the detecting means.

8. A fuel vapor treatment apparatus comprising:

a fuel vapor passage in which fuel vapor produced in a fuel tank flows;

a volume chamber provided in the fuel vapor passage for enlarging a passage volume;

a pump received in the volume chamber for generating a fluid flow in the fuel vapor passage;

detecting means which detects a physical quantity in correlation with a fuel vapor concentration at the downstream side of the volume chamber in the fuel vapor passage; and calculating means which calculates the fuel vapor concentration in the fuel vapor passage based upon the physical quantity detected by the detecting means.

9. A fuel vapor treatment apparatus according to claim 8, wherein:

the physical quantity detected by the detecting means includes a pressure in the fuel vapor passage.

10. A fuel vapor treatment apparatus according to claim 8, further comprising:

a canister for communicating with the fuel tank and the fuel vapor passage, wherein:

the canister includes an adsorbing material for adsorbing the fuel vapor produced in the fuel tank in such a way as to be desorbed to the fuel vapor passage.

11. A fuel vapor treatment apparatus according to claim 8, further comprising:

second detecting means which detects a physical quantity in correlation with a fluid flow in the fuel vapor passage during operating of the pump, the second detecting means being provided in addition to first detecting means as the detecting means; and determining means which determines fuel vapor leakage from the fuel tank based upon the physical quantity detected by the second detecting means.

12. A fuel vapor treatment apparatus according to claim 11, wherein:

the physical quantity detected by the second detecting means includes a pressure in the fuel vapor passage.

* * * * *